US012742247B2

(12) United States Patent
Karuppaiah

(10) Patent No.: US 12,742,247 B2
(45) Date of Patent: Sep. 22, 2026

(54) HYDROPHILIC MEMBER WITH CATION AND ANION CONDUCTING MEMBRANES

(71) Applicant: Ohmium International, Inc., Newark, CA (US)

(72) Inventor: Chockkalingam Karuppaiah, Fremont, CA (US)

(73) Assignee: Ohmium International, Inc., Newark, CA (US)

( * ) Notice: Subject to any disclaimer, the term of this patent is extended or adjusted under 35 U.S.C. 154(b) by 621 days.

(21) Appl. No.: 18/116,143

(22) Filed: Mar. 1, 2023

(65) Prior Publication Data

US 2023/0279564 A1 Sep. 7, 2023

Related U.S. Application Data

(60) Provisional application No. 63/315,479, filed on Mar. 1, 2022.

(51) Int. Cl.

| | |
|---|---|
| ***C25B 9/19*** | (2021.01) |
| ***C25B 1/04*** | (2021.01) |
| ***C25B 9/23*** | (2021.01) |
| ***C25B 13/02*** | (2006.01) |
| ***C25B 13/08*** | (2006.01) |

(52) U.S. Cl.

CPC ..... *C25B 9/19* (2021.01); *C25B 1/04* (2013.01); *C25B 9/23* (2021.01); *C25B 13/02* (2013.01); *C25B 13/08* (2013.01)

(58) Field of Classification Search

None

See application file for complete search history.

(56) References Cited

U.S. PATENT DOCUMENTS

| | | | |
|---|---|---|---|
| 5,840,192 | A | 11/1998 | El Moussaoui et al. |
| 6,010,612 | A | 1/2000 | Freire et al. |
| 6,238,534 | B1 | 5/2001 | Mao et al. |
| 6,756,150 | B2 | 6/2004 | Karuppaiah et al. |
| 7,608,356 | B2 | 10/2009 | Risen et al. |
| 7,947,411 | B1 | 5/2011 | Morioka |
| 8,669,499 | B2 | 3/2014 | Conrad |
| 11,268,200 | B2 * | 3/2022 | Oener ..... C25B 9/23 |
| 11,616,246 | B2 | 3/2023 | Ramani et al. |
| 12,091,518 | B2 | 9/2024 | Karuppaiah et al. |
| 12,152,117 | B2 | 11/2024 | Karuppaiah et al. |

(Continued)

FOREIGN PATENT DOCUMENTS

| | | | |
|---|---|---|---|
| CN | 102104155 | A | 6/2011 |
| CN | 106961838 | B | 10/2016 |

(Continued)

OTHER PUBLICATIONS

Abdu et al., Catalytic Polyelectrolyte Multilayers at the Bipolar Membrane Interface, ACS Applied Materials & Interfaces, vol. 5, No. 21, Oct. 2013, p. 10445-10455 (Year: 2013).*

(Continued)

*Primary Examiner* — Harry D Wilkins, III

(74) *Attorney, Agent, or Firm* — Polsinelli LLP

(57) ABSTRACT

Described herein are membrane assemblies for use in generating hydrogen and oxygen. The membrane assemblies include a cation exchange membrane, an anion exchange membrane, and a hydrophilic layer disposed between the anion exchange membrane and the cation exchange membrane.

20 Claims, 8 Drawing Sheets

(56) References Cited

U.S. PATENT DOCUMENTS

| | | | | |
|---|---|---|---|---|
| 12,338,539 | B1 | 6/2025 | Karuppaiah et al. | |
| 12,359,326 | B1 | 7/2025 | Karuppaiah et al. | |
| 2001/0031389 | A1 | 10/2001 | Appleby et al. | |
| 2003/0059657 | A1 | 3/2003 | Stone et al. | |
| 2003/0175579 | A1 | 9/2003 | Uchida | |
| 2003/0190517 | A1 | 10/2003 | Elter et al. | |
| 2003/0232714 | A1 | 12/2003 | Yan | |
| 2004/0191601 | A1 | 9/2004 | Grot | |
| 2006/0204831 | A1 | 9/2006 | Yan et al. | |
| 2014/0315121 | A1 | 10/2014 | Ghielmi et al. | |
| 2017/0338494 | A1 | 11/2017 | Yoon et al. | |
| 2019/0077780 | A1 | 3/2019 | Shu et al. | |
| 2019/0127865 | A1* | 5/2019 | Li | C25B 3/26 |
| 2019/0245233 | A1 | 8/2019 | Pintauro et al. | |
| 2019/0312293 | A1 | 10/2019 | Ramani et al. | |
| 2020/0208278 | A1 | 7/2020 | Li et al. | |
| 2020/0240023 | A1 | 7/2020 | Cave et al. | |
| 2020/0370188 | A1* | 11/2020 | Oener | C25B 13/08 |
| 2022/0049367 | A1 | 2/2022 | Ballantine et al. | |
| 2022/0243344 | A1 | 8/2022 | Yang et al. | |
| 2023/0047140 | A1 | 2/2023 | Zhang et al. | |
| 2023/0287587 | A1 | 9/2023 | Rojas Herrera | |
| 2024/0158591 | A1 | 5/2024 | Karuppaiah et al. | |
| 2024/0158937 | A1 | 5/2024 | Karuppaiah et al. | |
| 2025/0084226 | A1 | 3/2025 | Karuppaiah et al. | |
| 2025/0305168 | A1 | 10/2025 | Subramani et al. | |
| 2026/0022474 | A1 | 1/2026 | Karuppaiah et al. | |

FOREIGN PATENT DOCUMENTS

| | | | |
|---|---|---|---|
| CN | 107737614 | A | 2/2018 |
| CN | 210340758 | U | 4/2020 |
| CN | 114899464 | | 8/2022 |
| CN | 116364947 | A | 6/2023 |
| EP | 4486507 | A1 | 1/2025 |
| EP | 4619570 | A2 | 9/2025 |
| JP | 2006216382 | A | 8/2006 |
| JP | 2008204664 | | 9/2008 |
| JP | 2009212008 | | 9/2009 |
| JP | 2010092609 | A | 4/2010 |
| JP | 2025540637 | A | 12/2025 |
| KR | 20070098157 | | 10/2007 |
| RU | 2352384 | | 4/2009 |
| WO | 2017205458 | A1 | 11/2017 |
| WO | 2018236649 | A1 | 12/2018 |
| WO | 2022226219 | A1 | 10/2022 |
| WO | 2023167924 | A1 | 9/2023 |
| WO | 2024107748 | A2 | 5/2024 |
| WO | 2025207955 | A1 | 10/2025 |
| WO | 2026019434 | A1 | 1/2026 |

OTHER PUBLICATIONS

Venugopal et al., Fundamental studies on a new series of SPSEBS-PVA-QPSEBS bipolar membrane: Membrane preparation and characterization, Journal of Applied Polymer Science, vol. 127, No. 6, Mar. 2013, pp. 4983-4990 (Year: 2013).*

U.S. Appl. No. 18/778,577, Office Action dated Oct. 17, 2024.

PCT Application No. PCT/US2023/079671, International Preliminary Report on Patentability dated May 22, 2025.

PCT Application No. PCT/US2025/021868, International Search Report and Written Opinion dated Jul. 15, 2025.

Han et al., "Highly conductive and stable hybrid ionic cross-linked sulfonated PEEK for fuel cell" Electrochimica Acta, 353-361, 2018.

Sazali et al., "Influence of dip-coating times towards oxygen separation performance" IOP Conf. Series: Materials Science and Engineering, 2020.

Thomas et al., "Influence of Ionomer Content in Catalyst Layers on Direct Methanol Fuel Cell Performance" Journal of the Electrochemical Society, 146(12): 4354-4359, 1999.

PCT Application No. PCT/US2023/079671 International Search Report and Written Opinion dated Apr. 24, 2024.

PCT Application No. PCT/US2023/014274 International Search Report and Written Opinion dated Jun. 1, 2023.

PCT Application No. PCT/US2023/014274 International Preliminary Report on Patentability dated Sep. 12, 2024.

U.S. Appl. No. 18/509,078, Notice of Allowance dated Sep. 9, 2024.

Zeliger, H., "A New Air Electrode for Fuel Cells," Journal of The Electrochemical Society, vol. 114, No. 3, p. 236.

Wilson, M. et al., "High Performance Catalyzed Membranes of Ultra-low Pt Loadings for Polymer Electrolyte Fuel Cells," Journal of The Electrochemical Society, vol. 139, No. 2, pp. L28-L30.

U.S. Appl. No. 18/509,078, filed Nov. 14, 2023, Chockkalingam Karuppaiah, Composite Ion Exchange Membranes and Methods of Making the Same.

U.S. Appl. No. 18/521,700, filed Nov. 28, 2023, Chockkalingam Karuppaiah, Composite Ion Exchange Membranes and Methods of Making the Same.

PCT Application No. PCT/US2024/038843 International Search Report and Written Opinion dated Sep. 23, 2024.

U.S. Appl. No. 18/778,577, filed Jul. 19, 2024, Chockkalingam Karuppaiah, Hybrid Electrocatalyst Layers for Membrane-Based Electrochemical Devices and Processes for Making the Same.

U.S. Appl. No. 18/521,700, Office Action dated Feb. 20, 2024.

U.S. Appl. No. 18/509,078, Office Action dated May 31, 2024.

PCT Application No. PCT/US23/79671 Invitation to Pay Additional Fees dated Feb. 15, 2024.

U.S. Appl. No. 18/912,526, Office Action dated Dec. 18, 2024.

CN Application No. 202510602937.4 Office Action dated Nov. 10, 2025.

U.S. Appl. No. 19/211,926, Non-Final Office Action dated Mar. 5, 2026.

CN Application No. 202510602937.4, Final Office Action dated Apr. 26, 2026.

Balster et al., "Tailoring the interface layer of the bipolar membrane," Journal of Membrane Science, vol. 365, No. 1-2, Sep. 25, 2010, pp. 389-398.

EP Application No. 23763889.5, Extended European Search Report dated Jan. 19, 2026.

* cited by examiner

HYDROPHILIC MEMBER WITH CATION AND ANION CONDUCTING MEMBRANES

CROSS-REFERENCE TO RELATED APPLICATIONS

This application claims priority to U.S. Provisional Application No. 63/315,479 entitled "HYDROPHILIC MEMBER WITH CATION AND ANION CONDUCTING MEMBRANES", filed Mar. 1, 2022, the entire contents of which are incorporated by reference herein.

FIELD OF THE DISCLOSURE

The present disclosure relates to ion-exchange membrane assemblies for generating hydrogen. Accordingly, the disclosure is related to the fields of chemical and electrical engineering.

BACKGROUND

Traditionally ion conducting membranes used in electrochemical applications are either cation or anion conducting membranes. Of late, especially in fuel cells, hybrid membranes, wherein both types of membranes are used to optimize performance and enable lower capital cost. In the case of electrolyzers, utilizing membranes with this architecture requires water transport to the center of the membrane. Generally, this is accomplished by adding water channels to direct water to the center of the membranes; however, this adds to the resistance of the membrane, thus impacting performance.

What is needed is a hybrid ion conducting membrane that includes water transport to the center of the membrane without the use of water channels.

SUMMARY OF THE DISCLOSURE

Provided herein are ion-exchange membrane assemblies for the generation of hydrogen. The membrane assembly comprises an anion exchange membrane, a cation exchange membrane, and a hydrophilic layer disposed between the anion exchange membrane and the cation exchange membrane. In some embodiments, the anion exchange membrane may be a hydroxide ion-conducting membrane. In some embodiments, the cation exchange membrane is a proton-conducting membrane. In some embodiments, the hydrophilic layer comprises a polymer with hydrophilic groups. In some aspects, the hydrophilic layer further comprises portions of the anion exchange membrane and the cation exchange membrane. In some examples, pores of the hydrophilic layer accept portions of the cation exchange membrane and the anion exchange membrane. In some embodiments, the hydrophilic layer is laminated to the anion exchange membrane and the cation exchange membrane. In some embodiments, the hydrophilic layer has a porosity of about 10% to about 20%. In some embodiments, the hydrophilic layer has a thickness of about 10 microns to about 50 microns. In some embodiments, the anion exchange membrane has a thickness of about 10 microns to about 75 microns. In some embodiments, the cation exchange membrane has a thickness of about 10 microns to about 75 microns.

Further provided herein is a membrane electrode assembly comprising the membrane assembly of the present disclosure, an anode comprising an anode catalyst, and a cathode comprising a cathode catalyst. In some embodiments, the anode catalyst comprises nickel. In some aspects, the nickel is selected from the group consisting of nickel metal, nickel alloys, and nickel spinels. In some additional aspects, the nickel spinels have the general formula $NiM_2O_4$, wherein M is selected from the group consisting of aluminum, chromium, manganese, iron, and cobalt. In some embodiments, the anode catalyst is supported on oxidatively stable and/or electrically conductive materials. In some embodiments, the cathode catalyst comprises platinum. In some aspects, the platinum is selected from the group consisting of platinum metals, platinum alloys, and platinum supported on a conductive substrate. In some examples, the conductive substrate is carbon. In some embodiments, the anode has a thickness of about 20 microns to about 80 microns. In some embodiments, the cathode has a thickness of about 20 microns to about 80 microns.

Further provided herein is a stack for producing hydrogen, the stack comprising one or more membrane assemblies of the present disclosure and/or one or more membrane electrode assemblies of the present disclosure. In some embodiments, the stack further comprises a water manifold. In some aspects, the hydrophilic layer is disposed within the water manifold. In some embodiments, the stack further comprises coolant channels. In some embodiments, the stack further comprises a water inlet. In some embodiments, the stack further comprises gas manifolds. In some embodiments, the stack comprises about 1 to about 500 membrane assemblies or membrane electrode assemblies.

Further provided herein is a system comprising a stack of the present disclosure. In some embodiments, the system further comprises a heat exchanger. In some embodiments, the system further comprises a coolant and a heat exchange fluid. In some aspects, the coolant comprises water. In some aspects, the coolant further comprises glycol. In some aspects, the heat exchange fluid comprises glycol and water.

DETAILED DESCRIPTION

Described herein is a membrane assembly for use in an electrochemical stack that includes a cation exchange membrane, an anion exchange membrane, and a hydrophilic layer. Generally, the hydrophilic layer is laminated to the cation exchange membrane and the anion exchange membrane, as shown in FIG. 1. The hydrophilic layer is operable to provide water to the cation exchange membrane and the anion exchange membrane without use of pumps or other equipment. Compared to hybrid membranes currently available, the membrane assembly disclosed herein provides improved ionic conductivity and water transport without the use of water channels. In some embodiments, the membrane assemblies of the present disclosure may have an order of magnitude less resistance as compared to currently available hybrid membranes. Without wishing to be bound by theory, the hydrophilic layer may also trap ions or particulates that may otherwise reduce the conductivity of the membranes.

I. Membrane Assembly

Described herein is a membrane assembly that includes a cation exchange membrane, an anion exchange membrane, and a hydrophilic layer. The hydrophilic layer is disposed between the cation exchange membrane and the anion exchange membrane. In some embodiments, the hydrophilic layer may be laminated to the cation exchange membrane and the anion exchange membrane. In some additional embodiments, the hydrophilic layer may be porous such that the pores are able to accept portions of the cation exchange membrane and the anion exchange membrane, or of an anion exchange coating or a cation exchange coating.

Figure 1A:
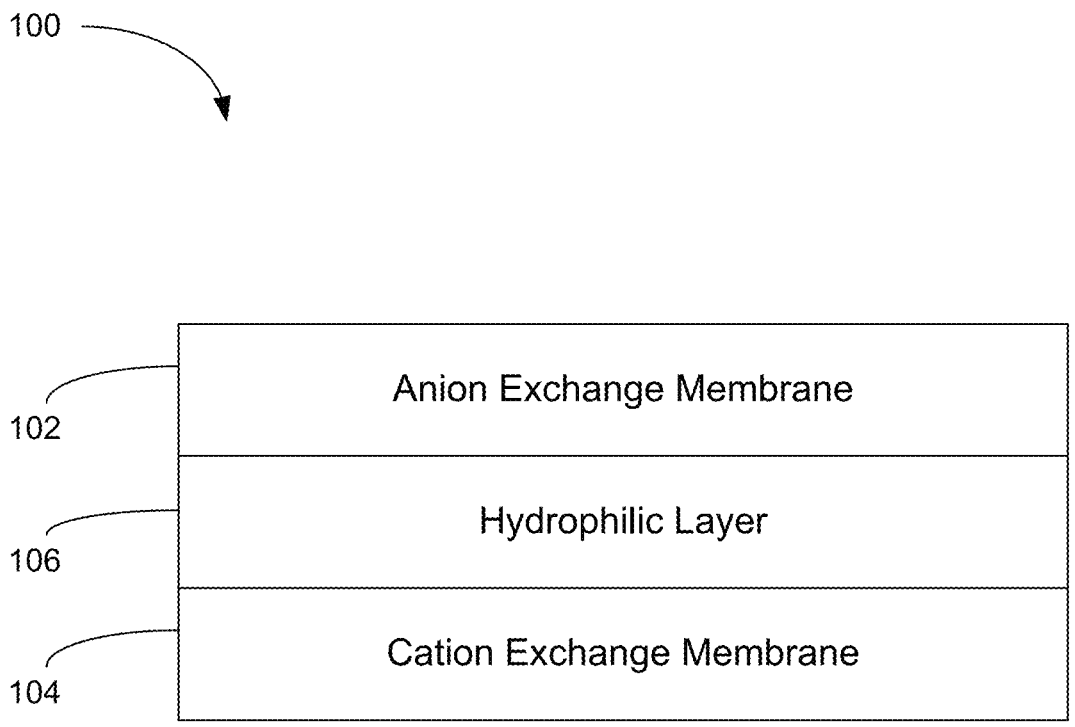
FIGS. 1A-1C show exemplary membrane assemblies of the present disclosure.

Referring to FIG. 1A, the membrane assembly 100 includes an anion exchange membrane 102, a cation exchange membrane 104, and a hydrophilic layer 106. The hydrophilic layer 106 is disposed between the anion exchange membrane 102 and the cation exchange membrane 104. The membranes and the hydrophilic layer may be oriented vertically, horizontally, or at an angle.

The anion exchange membrane 102 is operable to allow hydroxide ions to move through the membrane. Anion exchange membranes, and method of making and procuring the same, are generally known to those having ordinary skill in the art. In some embodiments, the anion exchange membrane may include imidazolium functionalized styrene polymers, polysulfone and derivatives thereof, polymers with quaternary phosphonium groups, polymers with anion exchange groups incorporated into the polymeric backbone, and other anion exchange materials known in the art.

The cation exchange membrane 104 is operable to allow protons to move through the membrane. Cation exchange membranes, and methods of making and procuring the same, are generally known to those having ordinary skill in the art. The cation exchange membrane may comprise a proton exchange membrane. In some embodiments, the cation exchange membrane may include a perfluorosulfonic acid polymer or copolymer, such as a sulfonated tetrafluoroethylene-based fluoropolymer-copolymer. In some aspects, the cation exchange membrane may include sulfonated poly (ether ether ketone) (sPEEK), sulfonated phenylated poly (phenylene) (sPPP), sulfonated polyether (sulfone) (SPES), sulfonated polystyrene-b-poly(ethylene-r-butylene-b-polystrene (S-SEBS), or combinations thereof. In some examples, the cation exchange membrane may comprise a Nafion® membrane having the formula $C_7HF_{13}O_5S{\cdot}C_2F_4$. In some additional examples, the cation exchange membrane may comprise Selemion CMV, Neosepta CMS, Fumasep FKS 30, or combinations thereof.

The hydrophilic layer 106 introduces water to the cation exchange membrane and the anion exchange membrane without increasing the resistance of the membrane assembly. Moreover, no pumps or other process equipment that may be used in other assemblies to introduce water to the membrane assembly are required.

The hydrophilic layer 106 may comprise a polymer with hydrophilic groups. In some aspects, the hydrophilic groups may be hydroxyl groups, carbonyl groups, carboxyl groups, amino groups, sulfhydryl groups, phosphate groups, sulfonic acid groups, and other hydrophilic groups known in the art and combinations thereof. In some aspects, the polymer may further include hydrophilic linkages, such as ethers, esters, phosphodiester, and other hydrophilic linkages known in the art and combinations thereof. In some examples, the hydrophilic layer may comprise poly(2-hydroxyethyl methacrylate-co-ethylene dimethacrylate) (HEMA-co-EDMA), polyethylene glycol diacrylate (PEGDA), poly-2-hydroxyethyl methacrylate (PHEMA), polyvinylpyrrolidone (PVP), polyethylene glycol (PEG), polyetheretherketone (PEEK), polyethersulfone (PES), polyetherketoneketone (PEEKK), polyimide (PI), polyvinyl alcohol (PVA), or a combination thereof.

The hydrophilic layer may have a porosity in the range of about 10% to about 20%; for example, the hydrophilic layer may have a porosity from about 10% to about 12%, about 10% to about 14%, about 10% to about 16%, about 10% to about 18%, about 10% to about 20%, about 12% to about 20%, about 14% to about 20%, about 16% to about 20%, or about 18% to about 20%. In other aspects, the hydrophilic layer may have a porosity of about 10%, 11%, 12%, 13%, 14%, 15%, 16%, 17%, 18%, 19%, or about 20%. The pores of the hydrophilic layer may have an average diameter of about 1 micron to about 30 microns, about 5 microns to about 25 microns, about 5 microns to about 20 microns, about 10 microns to about 20 microns, or about 10 microns to about 15 microns.

The length of the membrane assembly may be about 5 cm to about 100 cm, about 10 cm to about 75 cm, or about 10 cm to about 50 cm; for example, the length of the membrane assembly may be about 10 cm, 15 cm, 20 cm, 25 cm, 30 cm, 35 cm, 40 cm, 45 cm, or about 50 cm. In some embodiments, the width of the membrane assembly may be about 10 cm to about 50 cm; for example, the width of the membrane assembly may be about 10 cm, 15 cm, 20 cm, 25 cm, 30 cm, 35 cm, 40 cm, 45 cm, or about 50 cm. In some examples, the length of the membrane assembly may be equal to the width of the membrane assembly. In an exemplary embodiment, the membrane assembly has a length of about 30 cm and a width of about 30 cm.

The outer layers of the membrane assembly (i.e., the anion exchange membrane and the cation exchange membrane) may each have a thickness of about 5 to about 100 microns, about 5 to about 75 microns, or about 10 to about 75 microns. In some aspects, the outer layers of the membrane assembly may each have a thickness of about 10 microns to about 15 microns, about 10 microns to about 25 microns, about 10 microns to about 35 microns, about 10 microns to about 45 microns, about 10 microns to about 55 microns, about 10 microns to about 65 microns, about 15 microns to about 75 microns, about 25 microns to about 75 microns, about 35 microns to about 75 microns, about 45 microns to about 75 microns, about 55 microns to about 75 microns, about 65 microns to about 75 microns, about 15 microns to about 65 microns, about 25 microns to about 55 microns, or about 35 microns to about 45 microns.

In some embodiments, the hydrophilic layer of the membrane assembly may have a thickness of about 5 to about 100 microns, about 5 to about 75 microns, or about 10 microns to about 50 microns. In some aspects, the hydrophilic layer of the membrane assembly may have a thickness of about 10 microns to about 20 microns, about 10 microns to about 30 microns, about 10 microns to about 40 microns, about 20 microns to about 50 microns, about 30 microns to about 50 microns, about 40 microns to about 50 microns, about 20 microns to about 40 microns, or about 20 microns to about 30 microns. In an exemplary embodiment, the hydrophilic layer of the membrane assembly has a thickness of about 25 microns.

In some embodiments, the thickness of the membrane assembly may be about 10 microns to about 400 microns, about 20 microns to about 300 microns, or about 30 microns to about 200 microns. In some aspects, the membrane assembly may have a thickness of about 30 microns to about 50 microns, about 30 microns to about 75 microns, about 30 microns to about 100 microns, about 30 microns to about 150 microns, or about 30 microns to about 200 microns.

Figure 1B:
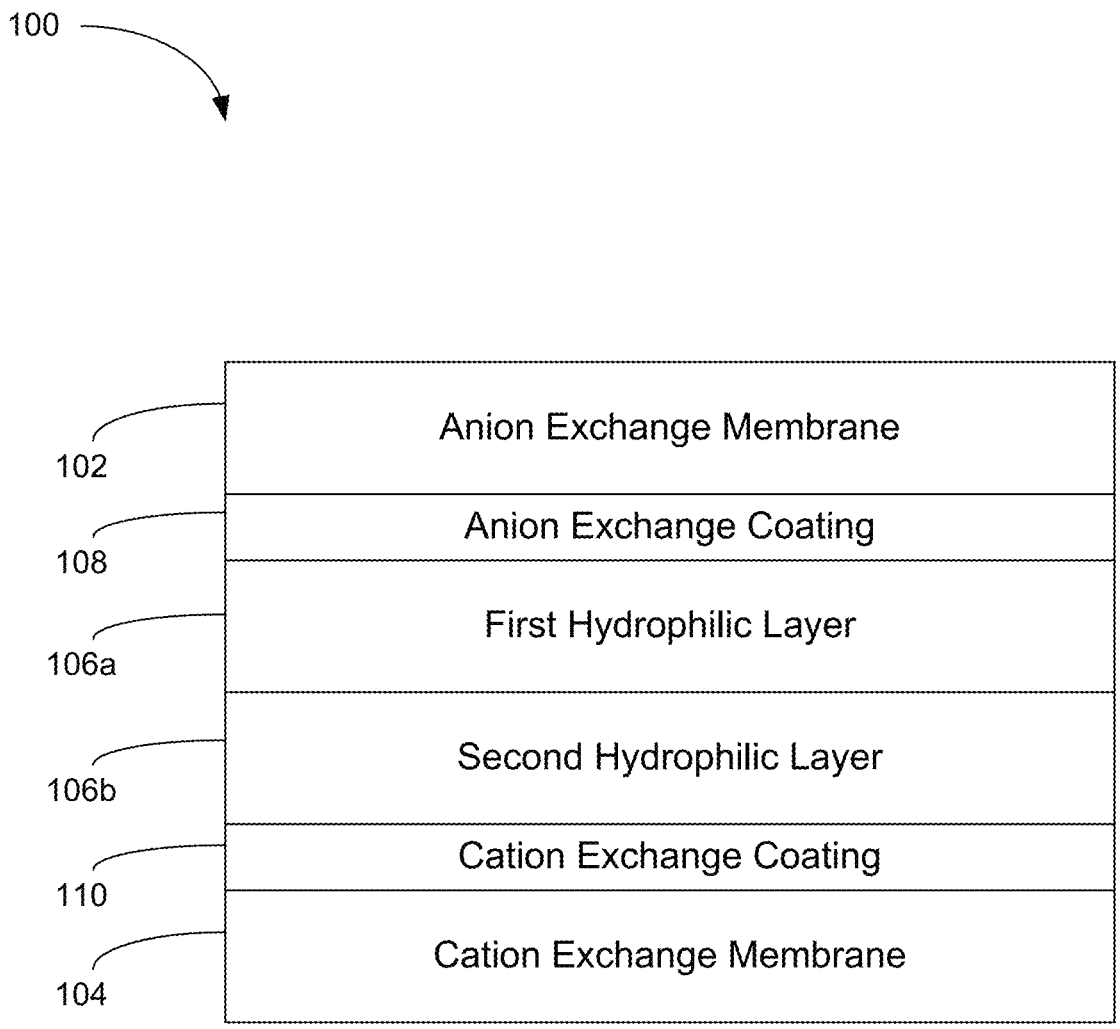

Referring now to FIG. 1B, in another embodiment, the membrane assembly comprises an anion exchange membrane 102, a cation exchange membrane 104, a first hydrophilic layer 106*a*, and a second hydrophilic layer 106*b*, wherein the first hydrophilic layer 106*a* comprises an anion exchange coating 108 on a side adjacent to the anion exchange membrane 102, and wherein the second hydrophilic layer 106*b* comprises a cation exchange coating 110 on a side adjacent to the cation exchange membrane 104. The anion exchange coating 108 is deposited on the side of the first hydrophilic layer 106*a* that is in operable contact with the anion exchange membrane 102, and the cation exchange coating 110 is deposited on the side of the second hydrophilic layer 106*b* that is in operable contact with the cation exchange membrane 104. The first hydrophilic layer 106*a* and the second hydrophilic layer 106*b* may each have the properties of the hydrophilic layer described above with respect to FIG. 1A. The first hydrophilic layer 106*a* and the second hydrophilic layer 106*b* may be identical in composition and/or dimension, or they may be different.

The anion exchange coating 108 may include a thin coating of an ionomer membrane material. The anion exchange coating 108 helps to maintain surface-to-surface contact between the hydrophilic layer 106 (or the first hydrophilic layer 106*a* when more than one hydrophilic layer is present) and the anion exchange membrane 102. The anion exchange coating 108 also facilitates capillary action that pulls water from the hydrophilic layer into the anion exchange membrane. The ionomer preferably comprises the same material as the anion exchange membrane 102, or a material with a similar chemical structure. Thus, the ionomer in the anion exchange coating 108 may include imidazolium functionalized styrene polymers or ionomers, polysulfone ionomers and derivatives thereof, ionomers with quaternary phosphonium groups, ionomers with anion exchange groups incorporated into the polymeric backbone, etc.

The anion exchange coating 108 may also include a solvent before the coating is dried. The solvent may include an alcohol solvent a hydrocarbon solvent such as an alkane solvent (including linear and branched alkanes), a substituted alkane, a cycloalkane, an alkene, a substituted alkene, a cycloalkene, an aromatic hydrocarbon solvent, or combinations thereof. In preferred embodiments, the solvent may include ethanol, isopropyl alcohol, or combinations thereof.

The anion exchange coating 108 may also include a catalyst. The catalyst may include platinum, titanium, iridium, gold, palladium, silver, ruthenium, rhodium, osmium, or other metal catalysts known in the art and combinations thereof. In a preferred embodiment, the catalyst in the anion exchange coating includes iridium. The catalyst may be present in the anion exchange coating in an amount from about 0.05 mg/cm$^2$ to about 1 mg/cm$^2$ of the coating surface area. For example, the catalyst may be present in the anion exchange coating in an amount from about 0.05 mg/cm$^2$ to about 0.25 mg/cm$^2$, about 0.05 mg/cm$^2$ to about 0.5 mg/cm$^2$, about 0.05 mg/cm$^2$ to about 0.75 mg/cm$^2$, about 0.05 mg/cm$^2$ to about 1 mg/cm$^2$, about 0.25 mg/cm$^2$ to about 1 mg/cm$^2$, about 0.5 mg/cm$^2$ to about 1 mg/cm$^2$, or about 0.75 mg/cm$^2$ to about 1 mg/cm$^2$. Further the catalyst may be present in the anion exchange coating in an amount of about 0.05 mg/cm$^2$, about 0.1 mg/cm$^2$, about 0.15 mg/cm$^2$, about 0.2 mg/cm$^2$, about 0.25 mg/cm$^2$, about 0.3 mg/cm$^2$, about 0.35 mg/cm$^2$, about 0.4 mg/cm$^2$, about 0.45 mg/cm$^2$, about 0.5 mg/cm$^2$, about 0.55 mg/cm$^2$, about 0.6 mg/cm$^2$, about 0.65 mg/cm$^2$, about 0.7 mg/cm$^2$, about 0.75 mg/cm$^2$, about 0.8 mg/cm$^2$, about 0.85 mg/cm$^2$, about 0.9 mg/cm$^2$, about 0.95 mg/cm$^2$, or about 1 mg/cm$^2$.

The cation exchange coating 110 may include a thin coating of an ionomer membrane material. The cation exchange coating 110 helps to maintain surface-to-surface contact between the hydrophilic layer 106 (or the second hydrophilic layer 106*b* when more than one hydrophilic layer is present) and the cation exchange membrane 104. The cation exchange coating 110 also facilitates capillary action that pulls water from the hydrophilic layer into the anion exchange membrane 102. The ionomer preferably comprises the same material as the cation exchange membrane 104, or a material with a similar chemical structure. Thus, the ionomer in the cation exchange membrane 110 may include a perfluorosulfonic acid ionomer, such as a sulfonated tetrafluoroethylene-based fluoropolymer-copolymer.

The cation exchange coating 110 may also include a solvent before the coating is dried. The solvent may include an alcohol solvent a hydrocarbon solvent such as an alkane solvent (including linear and branched alkanes), a substituted alkane, a cycloalkane, an alkene, a substituted alkene, a cycloalkene, an aromatic hydrocarbon solvent, or combinations thereof. In preferred embodiments, the solvent may include ethanol, isopropyl alcohol, or combinations thereof.

The cation exchange coating 110 may also include a catalyst. The catalyst may include platinum, titanium, iridium, gold, palladium, silver, ruthenium, rhodium, osmium, or other metal catalysts known in the art and combinations thereof. In a preferred embodiment, the catalyst in the cation exchange coating includes gold. The catalyst may be present in the cation exchange coating in an amount from about 0.05 mg/cm$^2$ to about 0.4 mg/cm$^2$ of the coating surface area. For example, the catalyst may be present in the cation exchange coating in an amount from about 0.05 mg/cm$^2$ to about 0.1 mg/cm$^2$, about 0.05 mg/cm$^2$ to about 0.2 mg/cm$^2$, about 0.05 mg/cm$^2$ to about 0.3 mg/cm$^2$, about 0.05 mg/cm$^2$ to about 0.4 mg/cm$^2$, about 0.1 mg/cm$^2$ to about 0.4 mg/cm$^2$, about 0.2 mg/cm$^2$ to about 0.4 mg/cm$^2$, or about 0.3 mg/cm$^2$ to about 0.4 mg/cm$^2$. Further, the catalyst may be present in the cation exchange coating in an amount of about 0.05 mg/cm$^2$, about 0.1 mg/cm$^2$, about 0.15 mg/cm$^2$, about 0.2 mg/cm$^2$, about 0.25 mg/cm$^2$, about 0.3 mg/cm$^2$, about 0.35 mg/cm$^2$, or about 0.4 mg/cm$^2$.

Figure 1C:
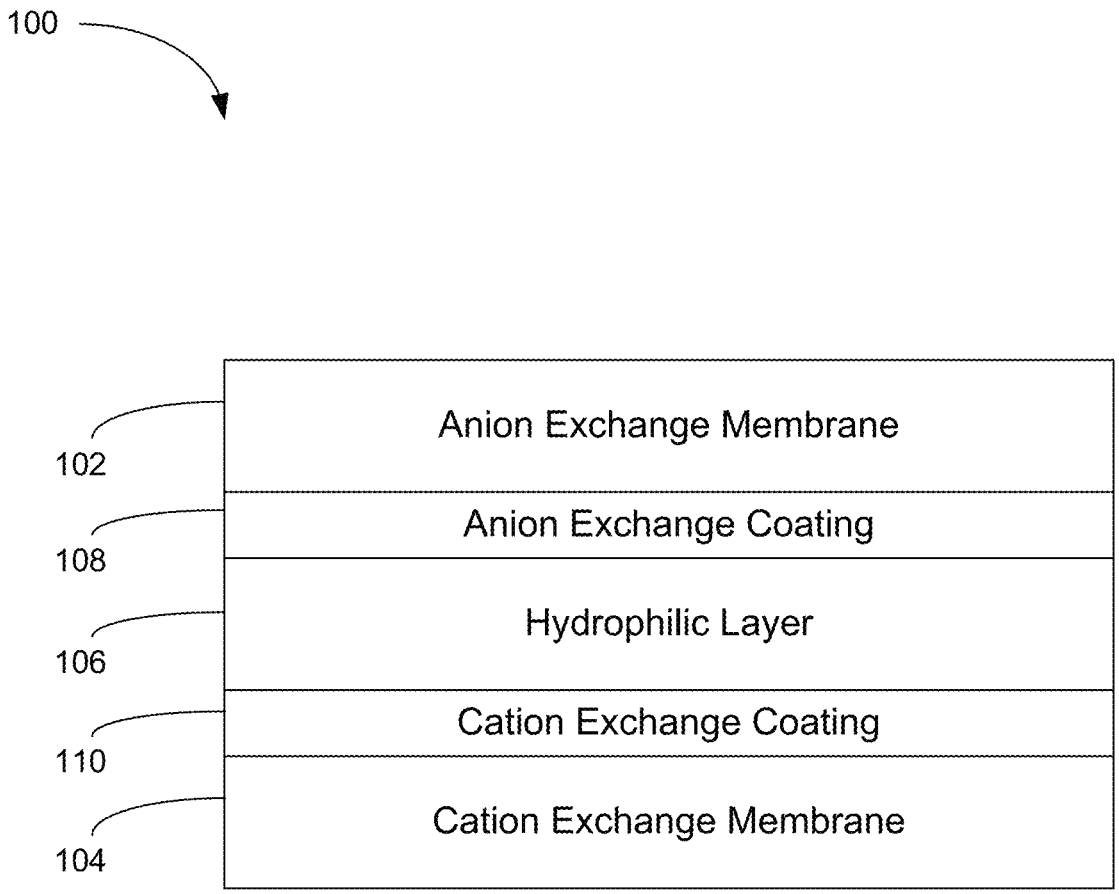

Referring now to FIG. 1C, in another embodiment, the membrane assembly comprises an anion exchange membrane 102, a cation exchange membrane 104, a hydrophilic layer 106, wherein the hydrophilic layer 106 comprises an anion exchange coating 108 on a side adjacent to the anion exchange membrane 102, and a cation exchange coating 110 on a side adjacent to the cation exchange membrane 104. The anion exchange coating 108 is deposited on the side of the hydrophilic layer 106 that is in operable contact with the anion exchange membrane 102, and the cation exchange coating 110 is deposited on the side of the hydrophilic layer 106 that is in operable contact with the cation exchange membrane 104. Each of the layers may have the properties of each layer described above with respect to FIGS. 1A-1B.

The membrane assembly may be made by lamination, wherein the anion exchange membrane 102, the hydrophilic layer 106, and the anion exchange membrane 104 may be laminated together. In alternative embodiments, two of the three layers may be laminated first before laminating the third layer. By way of a non-limiting example, the anion exchange membrane 102 and the hydrophilic layer 106 may be laminated together before the cation exchange membrane 104 is laminated such that it is in operable contact with the hydrophilic layer 106 to form the membrane assembly. The lamination may be accomplished using rollers or compression between flat plates. Heat may also be applied during the lamination process to improve the surface-to-surface contact of each layer. In some additional embodiments, the lamination may be enabled by solvent annealing. The solvent may include alcohol-based solvents, such as ethanol or isopropyl alcohol.

The membrane assembly may also be made via a roll-to-roll manufacturing process. The roll-to-roll manufacturing process includes unrolling a flexible substrate (i.e., the cation exchange membrane or the anion exchange membrane) onto an assembly line, followed by coating a layer comprising an electrode catalyst (i.e. the anion exchange coating or a cation exchange coating) onto a side of the substrate. The unrolled, coated membrane may then be cut into the desired shape and dimension for incorporating into the membrane assembly.

The cation exchange coating and/or the anion exchange coating may be added to the hydrophilic layer using coating methods known in the art, such as roll-to-roll coating, doctor blade-based coating, spray coating (e.g., ultrasonic spraying), etc.

II. Membrane Electrode Assembly

Figure 2A:
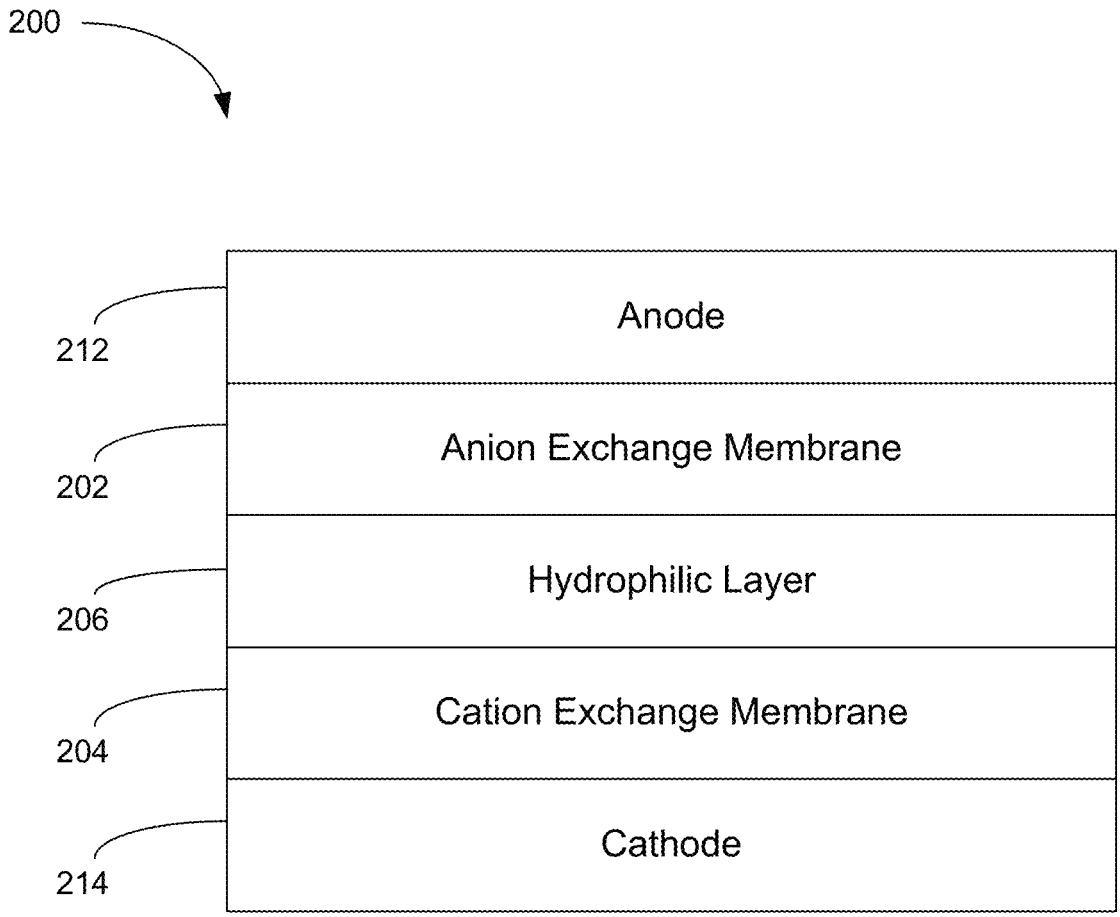
FIGS. 2A-2D show exemplary membrane electrode assemblies of the present disclosure.
Figure 2B:
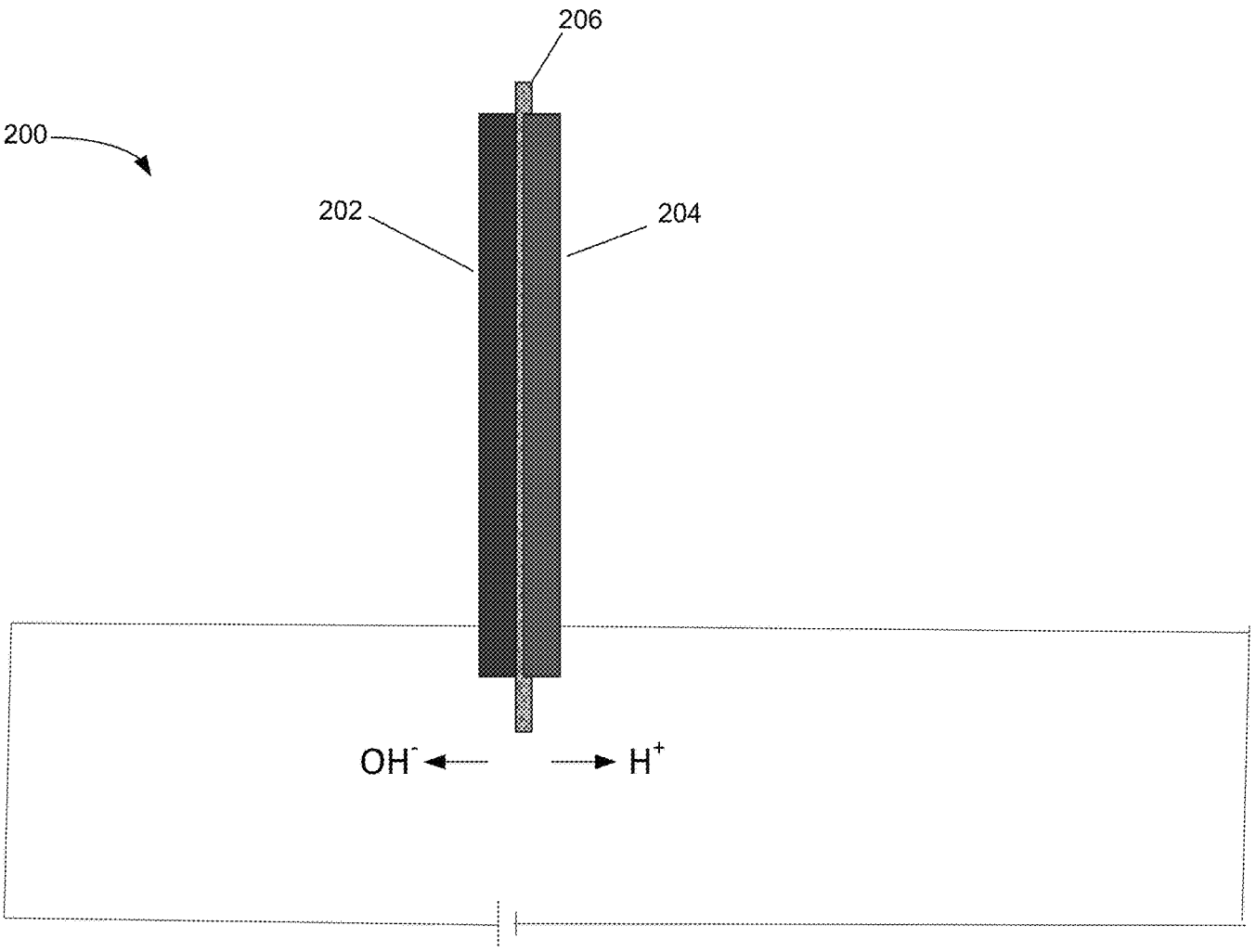

Further provided herein is a membrane electrode assembly that comprises the membrane assembly described in Section I above. Referring now to FIG. 2A, the membrane electrode assembly 200 includes an anion exchange membrane 202, a cation exchange membrane 204, a hydrophilic layer 206, an anode 212 comprising an anode catalyst, and a cathode 214 comprising a cathode catalyst. The anode 212 is disposed on a side of the anion exchange membrane 202 opposite to the side nearest to the hydrophilic layer 206, and the cathode 214 is disposed on the a side of the cation exchange membrane 204 opposite to the side nearest to the hydrophilic layer 206. The anode 212 is in operable contact with the anion exchange membrane 202, and the cathode 214 is in operable contact with the cation exchange membrane 204. The operable contact is sufficient to create an electrical current that draws protons through the cation exchange membrane 204 and hydroxide ions through the anion exchange membrane 202. An exemplary membrane electrode assembly circuit diagram having this configuration is provided in FIG. 2B.

Figure 2C:
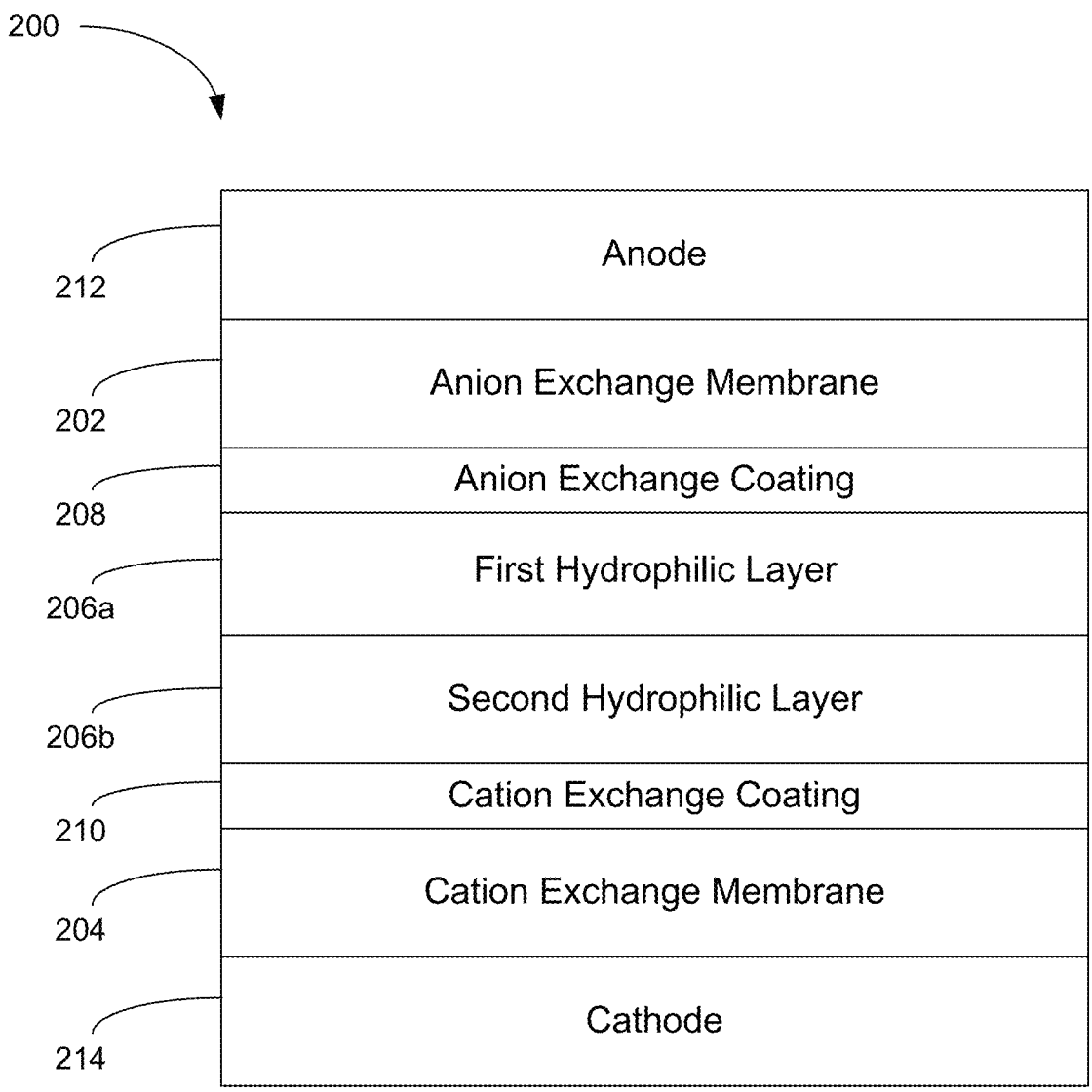

Referring now to FIG. 2C, another embodiment of the membrane electrode assembly is shown that includes an anion exchange membrane 202, a cation exchange membrane, 204, a first hydrophilic layer 206*a*, a second hydrophilic layer 206*b*, an anion exchange coating 208, a cation exchange coating 210, an anode 212, and a cathode 214. As shown in FIG. 2C, the first hydrophilic layer 206*a* is disposed between the second hydrophilic layer 206*b* and the anion exchange coating 208. The second hydrophilic layer 206*b* is disposed between the first hydrophilic layer 206*a* and the cation exchange coating 210. The first hydrophilic layer 206*a* and the second hydrophilic layer 206*b* may have the same composition and/or dimensions, or they may be different. Those having skill in the art will appreciate that a membrane electrode assembly of FIG. 2C may alternatively include a single hydrophilic layer, similar to the membrane electrode assembly of FIG. 2A.

Figure 2D:
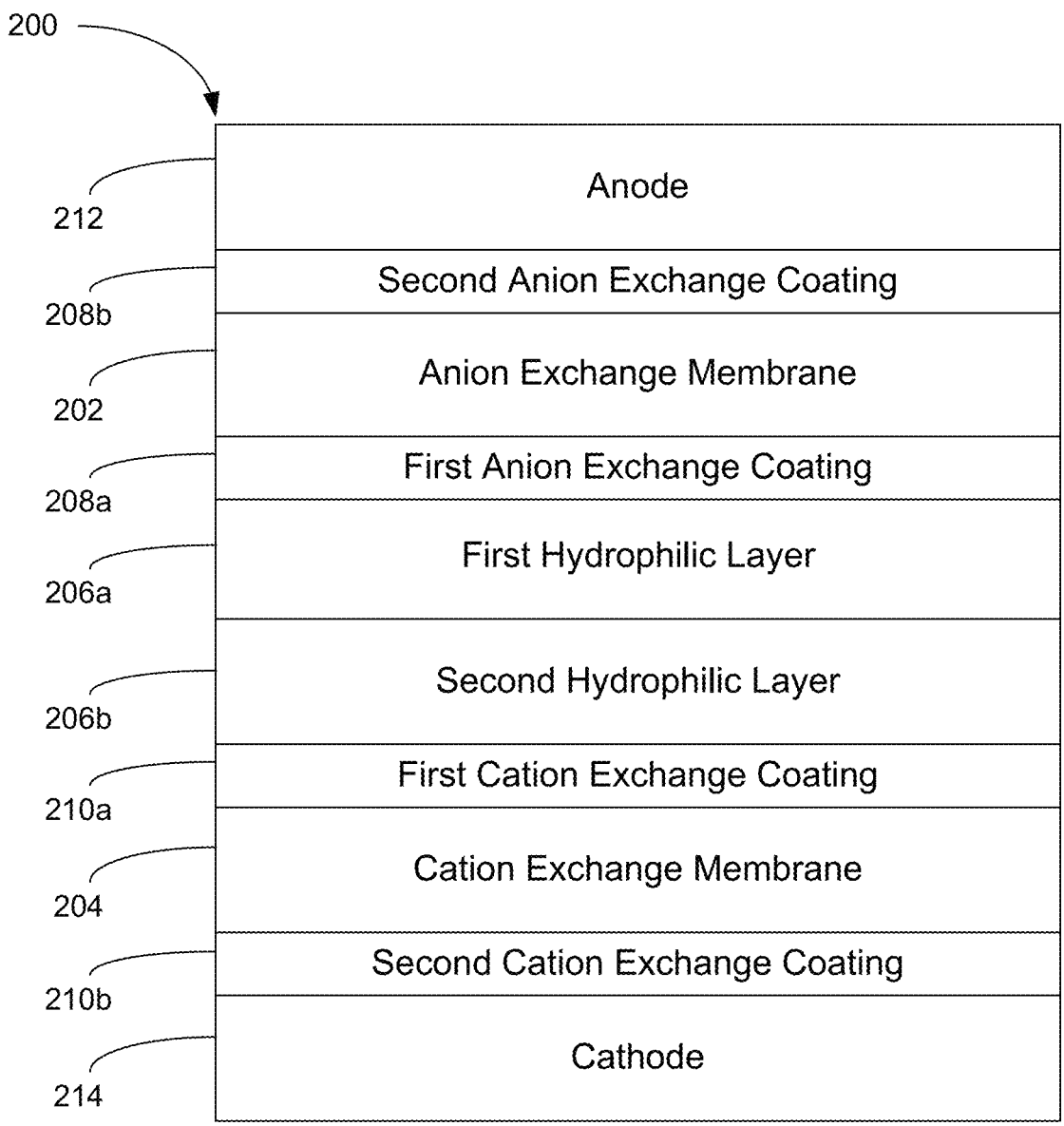

Referring now to FIG. 2D, another embodiment of the membrane electrode assembly is shown that includes an anion exchange membrane 202, a cation exchange membrane, 204, a first hydrophilic layer 206*a*, a second hydrophilic layer 206*b*, a first anion exchange coating 208*a*, a second anion exchange coating 208*b*, a first cation exchange coating 210*a*, a second cation exchange coating 210*b*, an anode 212, and a cathode 214. As shown in FIG. 2D, the first anion exchange coating 208*a* is disposed between the first hydrophilic layer 206*a* and the anion exchange membrane 202. The second anion exchange coating 208*b* is disposed between the anion exchange membrane 202 and the anode 200. The first cation exchange coating 210*a* is disposed between the second hydrophilic layer 206*b* and the cation exchange membrane 204. The second cation exchange coating 210*b* is disposed between the cation exchange membrane 204 and the cathode 214. The first anion exchange coating 208*a* and the second anion exchange coating 208*b* may be any anion exchange coating described in Section I above. The first anion exchange coating 208*a* and the second anion exchange coating 208*b* may have the same composition, or they may have a different composition. The first cation exchange coating 210*a* and the second cation exchange coating 210*b* may be any cation exchange coating described in Section I above. The first cation exchange coating 210*a* and the second cation exchange coating 210*b* may have the same composition, or they may have a different composition. Those having skill in the art will appreciate that a membrane electrode assembly of FIG. 2D may alternatively include a single hydrophilic layer, similar to the membrane electrode assembly of FIG. 2A.

It will be understood in the description that follows that reference made to a membrane electrode assembly having a single hydrophilic layer may apply equally to a reference made to a membrane electrode assembly having more than one hydrophilic layer (e.g., a first hydrophilic layer and a second hydrophilic layer).

The assembly operates by drawing water through the hydrophilic layer. Hydroxide ions are consumed at the anode catalyst by the following reaction.

$$4OH^- \rightarrow O_2 + 2H_2O + 2e^-$$

Protons are consumed at the cathode catalyst by the following reaction.

$$2H^+ + 2e^- \rightarrow H_2$$

As protons are consumed at the cathode catalyst, the proton concentration at the cathode catalyst decreases. Thus, a concentration gradient between the cathode catalyst and the hydrophilic layer is created, wherein the proton concentration at the cathode catalyst is low and the proton concentration at the hydrophilic layer is high. Similarly, as hydroxide ions are consumed at the anode catalyst, the hydroxide ion concentration at the anode catalyst decreases. Thus, a concentration gradient between the anode catalyst and the hydrophilic layer is created, wherein the hydroxide ion concentration at the anode catalyst is low and the hydroxide ion concentration at the hydrophilic layer is high. These concentration gradients facilitate the diffusion of protons to the cathode catalyst and hydroxide ions to the anode catalyst.

Without wishing to be bound by theory, the rate at which water moves through the hydrophilic layer is primarily affected by two mechanisms. The first is the rate of consumption of the water via the electrolysis reaction. The rate of consumption is influenced mainly by the operating current density of the membrane electrode assembly and the type of polymers used in the anion exchange membrane, the cation exchange membrane, and the hydrophilic layer. Generally, higher current densities will increase the rate of water consumption. The second mechanism that affects the rate at which water moves through the hydrophilic layer is the osmotic drag. Osmotic drag may increase as oxygen builds up within the anion exchange membrane and/or in the anode catalyst materials. As the oxygen build-up increases, the flow of water becomes more limited.

The water may be drawn through the hydrophilic layer at a rate of up to about 5 L/min. For example, water may be drawn through the hydrophilic layer at a rate of up to about 5 L/min, up to about 4 L/min, up to about 3 L/min, up to about 2 L/min, up to about 1 L/min, up to about 0.5 L/min, or up to about 0.1 L/min. In some aspects, the water may be drawn through the hydrophilic layer at a rate of about 5 L/min or more.

Another benefit of the membrane electrode assembly is the separation of the anode catalyst from the hydrophilic layer. As a side reaction of the oxygen generation at the anode catalyst, peroxy radicals may be formed, which readily react with hydrocarbon species in the hydrophilic layer. This degrades and reduces the stability of the hydrophilic layer. By separating the hydrophilic layer from the anode catalyst, the interaction of the peroxy radicals with the hydrophilic layer is avoided or reduced.

The anode catalyst may comprise nickel. In some aspects, the nickel may be selected from the group consisting of nickel metal, nickel alloys, and nickel spinels (e.g., $NiAl_2O_4$). Nickel spinels of the present disclosure have the general formula $NiM_2O_4$, wherein M is selected from the group consisting of aluminum, chromium, manganese, iron, and cobalt. In some embodiments, the anode catalyst may be supported on oxidatively stable and/or electrically conductive materials. In some examples, the anode catalyst may be magnelli phase materials, such as $Ti_4O_7$.

The cathode catalyst may include platinum. In some aspects, the platinum may include platinum metal, platinum alloys, or platinum supported on a conductive substrate. In some aspects, the conductive substrate may include carbon.

The anode may have a thickness of about 20 microns to about 80 microns. In some aspects, the anode may have a thickness of about 20 microns to about 30 microns, about 30 microns to about 40 microns, about 40 microns to about 50 microns, about 50 microns to about 60 microns, about 60 microns to about 70 microns, or about 70 microns to about 80 microns. In some additional aspects, the anode may have a thickness of about 20 microns to about 40 microns, about 20 microns to about 50 microns, about 20 microns to about 60 microns, about 20 microns to about 70 microns, about 30 microns to about 80 microns, about 40 microns to about 80 microns, about 50 microns to about 80 microns, about 60 microns to about 80 microns, about 30 microns to about 70 microns, or about 40 microns to about 60 microns. In still additional aspects, the anode may have a thickness of about 20 microns, 25 microns, 30 microns, 35 microns, 40 microns, 45 microns, 50 microns, 55 microns, 60 microns, 65 microns, 70 microns, 75 microns, or about 80 microns.

The cathode may have a thickness of about 20 microns to about 80 microns. In some aspects, the cathode may have a thickness of about 20 microns to about 30 microns, about 30 microns to about 40 microns, about 40 microns to about 50 microns, about 50 microns to about 60 microns, about 60 microns to about 70 microns, or about 70 microns to about 80 microns. In some additional aspects, the cathode may have a thickness of about 20 microns to about 40 microns, about 20 microns to about 50 microns, about 20 microns to about 60 microns, about 20 microns to about 70 microns, about 30 microns to about 80 microns, about 40 microns to about 80 microns, about 50 microns to about 80 microns, about 60 microns to about 80 microns, about 30 microns to about 70 microns, or about 40 microns to about 60 microns. In still additional aspects, the cathode may have a thickness of about 20 microns, 25 microns, 30 microns, 35 microns, 40 microns, 45 microns, 50 microns, 55 microns, 60 microns, 65 microns, 70 microns, 75 microns, or about 80 microns.

The membrane electrode assembly may be made via heat lamination, wherein the anode and the cathode are assembled against the membrane assembly, followed by laminating anode and the cathode to the membrane assembly. Those having skill in the art will appreciate that the anode may be laminated to the membrane assembly first, followed by the cathode, or vice versa, or both the anode and the cathode may be laminated to the membrane assembly at the same time. Heat and mechanical compression may be applied to improve the lamination and increase surface-to-surface contact between each layer.

III. Stack

Described herein is an electrochemical stack (also referred to herein simply as a "stack") capable of generating hydrogen and oxygen using one or more of the membrane assemblies or the membrane electrode assemblies of the present disclosure. The membrane assembly may be any membrane assembly described in Section I. The membrane electrode assembly may be any membrane electrode assembly described in Section 2. The stack may include one or more membrane assemblies and/or one or more membrane electrode assemblies of the present disclosure. Each membrane electrode assembly defines an electrochemical cell for producing hydrogen and oxygen.

By using the membrane assemblies described herein, less equipment and fluid power is required to provide sufficient flow across the membrane electrode assembly. Traditionally, numerous dedicated flow channels with the proper size, spacing, and distribution would be required to provide adequate water flow across each of the membrane assemblies. The addition of the hydrophilic layer as described herein achieves control of this water flow across the membrane assembly and provides a constant supply of water as the water is consumed via the electrolysis.

The stack may include about 1 to about 500 membrane electrode assemblies of the present disclosure. In some aspects, the stack may include about 1 to about 10, about 10 to about 50, about 50 to about 100, about 100 to about 200, about 200 to about 300, about 300 to about 400, or about 400 to about 500 membrane electrode assemblies of the present disclosure. In some additional aspects, the stack may include about 1 to about 50, about 1 to about 100, about 1 to about 200, about 1 to about 300, about 1 to about 400, about 10 to about 500, about 50 to about 500, about 100 to about 500, about 200 to about 500, or about 300 to about 500 membrane electrode assemblies. In still further aspects, the stack may include about 1, 10, 50, 100, 200, 300, 400, or about 500 membrane electrode assemblies of the present disclosure.

Figure 3:
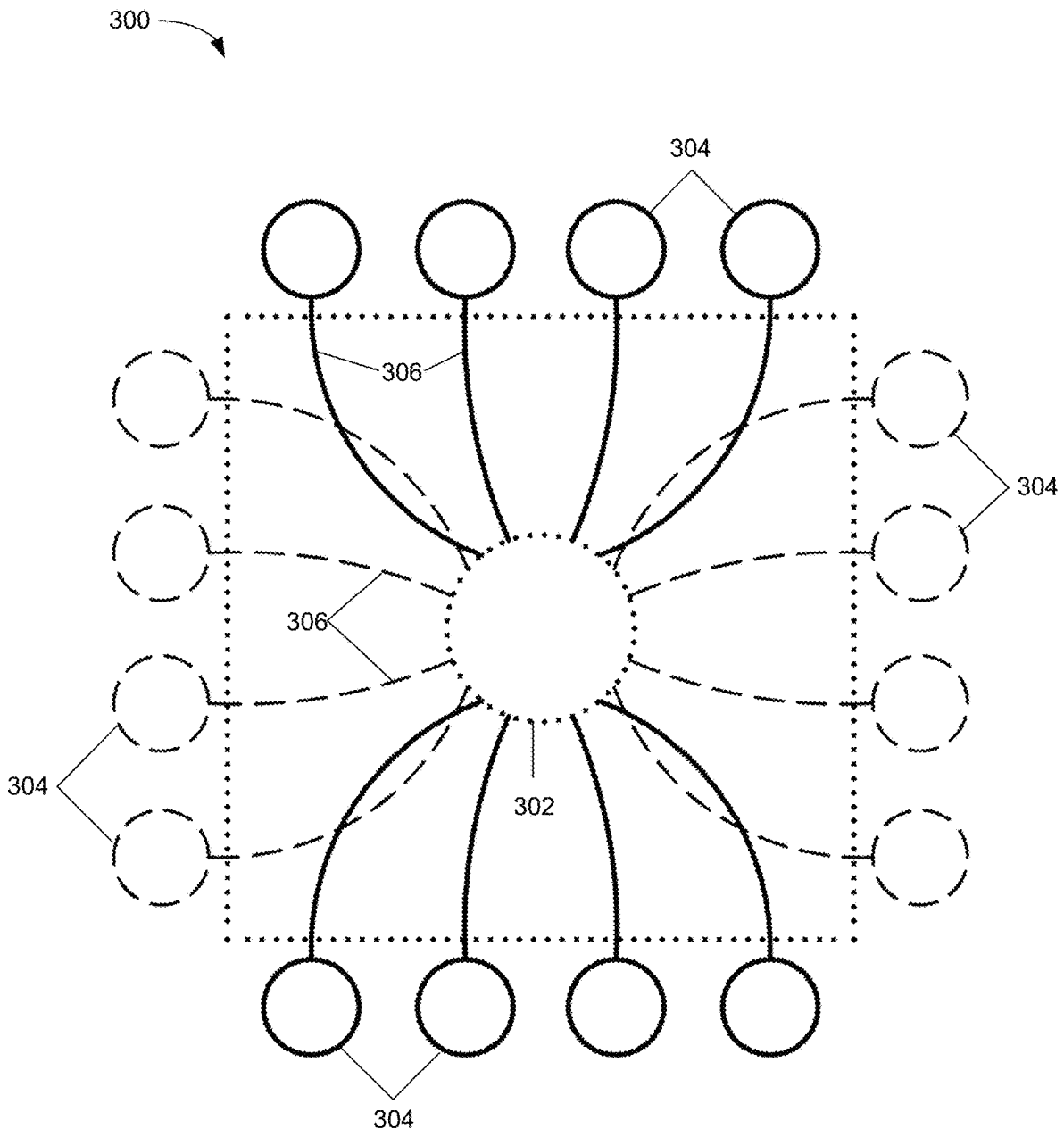
FIG. 3 shows a top-down cross-sectional diagram of a stack of the present disclosure.

Referring now to FIG. 3, the stack 300 may include a water inlet 302 operable to provide water to the hydrophilic layer. The water inlet 302 is dead-ended; i.e., there is no flow of water through the stack 300. Rather, water remains at the inlet 302, until absorbed and drawn into the membrane assembly. The water in the inlet is under a constant pressure, and thus is constantly replenished as the water is absorbed by the hydrophilic layer. In some embodiments, the water in the inlet may be under a constant pressure ranging from atmospheric pressure, 50 psi, 100 psi, 150 psi, 200 psi, 300 psi, or greater. In another embodiment, the water in the inlet may be under a constant pressure ranging from atmospheric pressure to about 30 psi, about 30 psi to about 50 psi, about 50 psi to about 100 psi, about 100 psi to about 150 psi, about 150 psi to about 200 psi, about 200 psi to about 300 psi, or greater than 300 psi. The water pressure must be sufficiently high to combat backpressures created in the stack via generation of hydrogen and oxygen. As shown in FIG. 3, the water inlet 302 may be located in the center of the stack. In some embodiments, the water inlet 302 may be a column that extends upward through the stack, supplying water to a plurality of membrane electrode assemblies stacked on top of one another. In some embodiments, the hydrophilic layer of the one or more membrane assemblies may be disposed within the water inlet.

The stack may include one or more gas manifolds 304. In some aspects as shown in FIG. 3, the stack includes one or more gas manifolds 304 to collect oxygen (solid lines) from the anode layers of one or more membrane electrode assemblies, and one or more gas manifolds 304 to collect hydrogen (dashed lines) from the cathode layers of one or more membrane electrode assemblies. The hydrogen and oxygen may be directed by the gas manifolds 304 to one or more gas collection lines 306 located on the outside of the stack. The gas may be collected through means known to those having ordinary skill in the art, such as tubing or hoses, external collection manifolds, a compressor, a tank, or via mechanical piping. Alternatively, the gas may be vented to another chamber.

The stack may include a water manifold. The water manifold is operable to provide water to the hydrophilic layers of the one or more membrane assemblies. The water may be water from a natural source, tap water, purified water, or another source of water. Preferably, the water is purified water, such as filtered water, distilled water, double-distilled water, or deionized water.

The water may have a conductivity of less than about 2 $mS/cm^2$. For example, the water may have a conductivity of less than 2 $mS/cm^2$, less than 1 $mS/cm^2$, less than 0.5 $mS/cm^2$, or less than 0.1 $mS/cm^2$.

The water may have a total solids content of less than about 1 wt % dissolved solids. For example, the water may have a total solids content of less than about 1 wt %, less than about 0.5 wt %, less than about 0.1 wt %, or less than about 0.01 wt % dissolved solids.

The stack may include coolant channels. The coolant channels may be operable to absorb heat generated within the stack. The coolant channels include a coolant. In some embodiments, the coolant may comprise water. In some additional embodiments, the coolant may comprise water mixed with a glycol, such as ethylene glycol or propylene glycol. In some additional embodiments, the coolant may comprise commercial coolants such as Therminol®. The coolant channels may be operably connected to a radiator to dissipate the heat absorbed by the coolant. The coolant may then be recycled back into the stack to absorb additional heat.

The stack may include a power cabinet. The power cabinet is operable to supply a current to the membrane electrode assembly. The power cabinet is connected to an alternating current (AC) power source. The power cabinet is then operable to rectify the AC power and convert it to direct current (DC) power. The DC power is then supplied to the membrane electrode assembly. In some embodiments, the power cabinet may include firmware to control the DC current supplied to the membrane electrode assembly, thereby controlling the amount of hydrogen and oxygen produced by the membrane electrode assembly.

IV. System

Further provided herein is a system for generating hydrogen and/or oxygen. The system includes a membrane assembly of Section I, a membrane electrode assembly of Section II, and/or a stack of Section III.

The system may include a heat exchanger. The heat exchanger may be any heat exchanger known in the art, such as a shell and tube heat exchanger, a plate heat exchanger, a plate and shell heat exchanger, an adiabatic wheel heat exchanger, a plate fin heat exchanger, a finned tube heat exchanger, or a pillow plate heat exchanger. The heat exchanger may be operable to remove heat generated by the stack or, alternatively, to provide heat to the stack when the stack is in a cold environment or during a startup cycle. In some embodiments, the system may comprise a coolant and a heat exchange fluid. The coolant may be the coolant described in Section III. In some embodiments, the heat exchange fluid may comprise water. In some aspects, the heat exchange fluid may further comprise a glycol, such as ethylene glycol or propylene glycol.

The system may include one or more downstream process operations. For example, the system may include a burner, a dryer, an oven, a blower, a pump, a reactor, or other process operations known in the art and combinations thereof. The hydrogen or the oxygen generated by the stack of the present disclosure may be used in such downstream processes for, e.g., purification, combustion, storage, etc.

The system may include water return lines to recover vaporized water from the hydrogen and/or from the oxygen produced by the stack. The water may be recovered by a dryer (e.g., pressure swing adsorption, temperature swing adsorption, or a hybrid pressure swing adsorption-temperature swing adsorption system), a phase separator, or other processes known in the art. The recovered water may be purified before returning to the stack via the water return lines.

EXEMPLARY EMBODIMENTS

Embodiment 1: A membrane assembly comprising: an anion exchange membrane, a cation exchange membrane, and a hydrophilic layer disposed between the anion exchange membrane and the cation exchange membrane.

Embodiment 2: The assembly of embodiment 1, wherein the anion exchange membrane is a hydroxide ion-conducting membrane.

Embodiment 3: The assembly of embodiment 2, wherein the anion exchange membrane comprises imidazolium functionalized styrene polymers, polysulfone and derivatives thereof, polymers with quaternary phosphonium groups, or combinations thereof.

Embodiment 4: The assembly of any one of embodiments 1-3, wherein the cation exchange membrane is a proton conducting membrane.

Embodiment 5: The assembly of embodiment 4, wherein the proton conducting membrane comprises a polymer having the formula $C_7HF_{13}O_5S{\cdot}C_2F_4$.

Embodiment 6: The assembly of any one of embodiments 1-5, wherein the cation exchange membrane comprises sulfonated poly(ether ether ketone) (sPEEK), sulfonated phenylated poly(phenylene) (sPPP), sulfonated polyether (sulfone) (SPES), sulfonated polystyrene-b-poly(ethylene-r-butylene-b-polystrene (S-SEBS), or combinations thereof.

Embodiment 7: The assembly of any one of embodiments 1-6, wherein the hydrophilic layer comprises a polymer with hydrophilic groups.

Embodiment 8: The assembly of any one of embodiments 1-7, wherein the hydrophilic layer is laminated to the anion exchange membrane and the cation exchange membrane.

Embodiment 9: The assembly of any one of embodiments 1-8, wherein the hydrophilic layer has a porosity from about 10% to about 20%.

Embodiment 10: The assembly of any one of embodiments 1-9, wherein the hydrophilic layer has a thickness from about 10 microns to about 50 microns.

Embodiment 11: The assembly of any one of embodiments 1-10, wherein the anion exchange membrane has a thickness from about 10 microns to about 75 microns.

Embodiment 12: The assembly of any one of embodiments 1-11, wherein the cation exchange membrane has a thickness from about 10 microns to about 75 microns.

Embodiment 13: The assembly of any one of embodiments 1-12, wherein the hydrophilic layer comprises a polymer selected from the group consisting of poly(2-hydroxyethyl methacrylate-co-ethylene dimethacrylate) (HEMA-co-EDMA), polyethylene glycol diacrylate (PEGDA), poly-2-hydroxyethyl methacrylate (PHEMA), polyvinylpyrrolidone (PVP), polyethylene glycol (PEG), polyetheretherketone (PEEK), polyethersulfone (PES), polyetherketoneketone (PEEKK), polyimide (PI), polyvinyl alcohol (PVA), or a combination thereof.

Embodiment 14: The membrane assembly of any one of embodiments 1-13, further comprising an anion exchange coating disposed between the hydrophilic layer and the anion exchange membrane.

Embodiment 15: The membrane assembly of embodiment 14, wherein the anion exchange coating comprises a catalyst selected from the group consisting of platinum, titanium, iridium, gold, palladium, silver, ruthenium, rhodium, osmium, and combinations thereof.

Embodiment 16: The membrane assembly of any one of embodiments 1-15, further comprising a cation exchange coating disposed between the hydrophilic layer and the cation exchange membrane.

Embodiment 17: The membrane assembly of claim 16, wherein the anion exchange coating comprises a catalyst selected from the group consisting of platinum, titanium, iridium, gold, palladium, silver, ruthenium, rhodium, osmium, and combinations thereof.

Embodiment 18: A membrane assembly comprising an anion exchange membrane, a cation exchange membrane, and a first hydrophilic layer and a second hydrophilic layer disposed between the anion exchange membrane and the cation exchange membrane, wherein the first hydrophilic layer is in operable contact with the anion exchange membrane and the second hydrophilic layer is in operable contact with the cation exchange membrane.

Embodiment 19: The assembly of embodiment 18, wherein the anion exchange membrane is a hydroxide ion-conducting membrane.

Embodiment 20: The assembly of embodiment 18 or embodiment 19, wherein the cation exchange membrane is a proton conducting membrane.

Embodiment 21: The assembly of embodiment 20, wherein the proton conducting membrane comprises a polymer having the formula $C_7HF_{13}O_5S{\cdot}C_2F_4$.

Embodiment 22: The assembly of any one of embodiments 18-21, wherein the cation exchange membrane comprises sulfonated poly(ether ether ketone) (sPEEK), sulfonated phenylated poly(phenylene) (sPPP), sulfonated polyether (sulfone) (SPES), sulfonated polystyrene-b-poly (ethylene-r-butylene-b-polystrene (S-SEBS), or combinations thereof.

Embodiment 23: The assembly of any one of embodiments 18-22, wherein the first hydrophilic layer comprises a polymer with hydrophilic groups.

Embodiment 24: The assembly of any one of embodiments 18-23, wherein the hydrophilic layer is laminated to the anion exchange membrane.

Embodiment 25: The assembly of any one of embodiments 18-24, wherein the second hydrophilic layer comprises a polymer with hydrophilic groups.

Embodiment 26: The assembly of any one of embodiments 18-25, wherein second hydrophilic layer is laminated to the cation exchange membrane.

Embodiment 27: The assembly of any one of embodiments 18-26, wherein the first hydrophilic layer has a porosity from about 10% to about 20%.

Embodiment 28: The assembly of any one of embodiments 18-27, wherein the first hydrophilic layer has a thickness from about 10 microns to about 50 microns.

Embodiment 29: The assembly of any one of embodiments 18-28, wherein the second hydrophilic layer has a porosity from about 10% to about 20%.

Embodiment 30: The assembly of any one of embodiments 18-29, wherein the second hydrophilic layer has a thickness from about 10 microns to about 50 microns.

Embodiment 31: The assembly of any one of embodiments 18-30, wherein the anion exchange membrane has a thickness from about 10 microns to about 75 microns.

Embodiment 32: The assembly of any one of embodiments 18-31, wherein the cation exchange membrane has a thickness from about 10 microns to about 75 microns.

Embodiment 33: The assembly of any one of embodiments 18-32, wherein the first hydrophilic layer comprises a polymer selected from the group consisting of poly(2-hydroxyethyl methacrylate-co-ethylene dimethacrylate) (HEMA-co-EDMA), polyethylene glycol diacrylate (PEGDA), poly-2-hydroxyethyl methacrylate (PHEMA), polyvinylpyrrolidone (PVP), polyethylene glycol (PEG), polyetheretherketone (PEEK), polyethersulfone (PES), polyetherketoneketone (PEEKK), polyimide (PI), polyvinyl alcohol (PVA), or a combination thereof.

Embodiment 34: The assembly of any one of embodiments 18-33, wherein the second hydrophilic layer comprises a polymer selected from the group consisting of poly(2-hydroxyethyl methacrylate-co-ethylene dimethacrylate) (HEMA-co-EDMA), polyethylene glycol diacrylate (PEGDA), poly-2-hydroxyethyl methacrylate (PHEMA), polyvinylpyrrolidone (PVP), polyethylene glycol (PEG), polyetheretherketone (PEEK), polyethersulfone (PES), polyetherketoneketone (PEEKK), polyimide (PI), polyvinyl alcohol (PVA), or a combination thereof.

Embodiment 35: The membrane assembly of any one of embodiments 18-34, further comprising an anion exchange coating disposed between the first hydrophilic layer and the anion exchange membrane.

Embodiment 36: The membrane assembly of any one of embodiments 18-35, wherein the anion exchange coating comprises a catalyst selected from the group consisting of platinum, titanium, iridium, gold, palladium, silver, ruthenium, rhodium, osmium, and combinations thereof.

Embodiment 37: The membrane assembly of any one of embodiments 18-36, further comprising a cation exchange coating disposed between the second hydrophilic layer and the cation exchange membrane.

Embodiment 38: The membrane assembly of embodiment 37, wherein the anion exchange coating comprises a catalyst selected from the group consisting of platinum, titanium, iridium, gold, palladium, silver, ruthenium, rhodium, osmium, and combinations thereof.

Embodiment 39: A membrane electrode assembly comprising: the membrane assembly of any one of embodiments 1-38; an anode comprising an anode catalyst; and a cathode comprising a cathode catalyst.

Embodiment 40: The assembly of embodiment 39, wherein the anode catalyst comprises nickel.

Embodiment 41: The assembly of embodiment 40, wherein the nickel is selected from the group consisting of nickel metal, nickel alloys, and nickel spinels.

Embodiment 42: The assembly of embodiment 41, wherein the nickel spinels have the general formula $NiM_2O_4$, wherein M is selected from the group consisting of aluminum, chromium, manganese, iron, and cobalt.

Embodiment 43: The assembly of any one of embodiments 39-42, wherein the anode catalyst is supported on oxidatively stable and/or electrically conductive materials.

Embodiment 44: The assembly of any one of embodiments 39-43, wherein the cathode catalyst comprises platinum.

Embodiment 45: The assembly of embodiment 44, wherein the platinum is selected from the group consisting of platinum metal, platinum alloys, and platinum supported on a conductive substrate.

Embodiment 46: The assembly of embodiment 45, wherein the conductive substrate comprises carbon.

Embodiment 47: The assembly of any one of embodiments 39-46, wherein the anode has a thickness from about 20 microns to about 80 microns.

Embodiment 48: The assembly of any one of embodiments 39-47, wherein the cathode has a thickness from about 20 microns to about 80 microns.

Embodiment 49: An electrochemical stack for producing hydrogen, the stack comprising one or more membrane assemblies of embodiments 1-38 and/or one or more membrane electrode assemblies of embodiments 39-48.

Embodiment 50: The stack of embodiment 49, further comprising a water manifold.

Embodiment 51: The stack of embodiment 50, wherein the hydrophilic layer is disposed within the water manifold.

Embodiment 52: The stack of any one of embodiments 49-51, further comprising coolant channels.

Embodiment 53: The stack of any one of embodiments 49-52, further comprising a water inlet.

Embodiment 54: The stack of any one of embodiments 49-53, further comprising one or more gas manifolds.

Embodiment 55: The stack of any one of embodiments 49-54, wherein the stack comprises from about 1 to about 500 membrane assemblies or membrane electrode assemblies.

Embodiment 56: A system comprising the stack of any one of embodiments 49-55.

Embodiment 57: The system of embodiment 56, further comprising a heat exchanger.

Embodiment 58: The system of embodiment 56 or 57, further comprising a coolant and a heat exchange fluid.

Embodiment 59: The system of embodiment 58, wherein the coolant comprises water.

Embodiment 60: The system of embodiment 59, wherein the coolant further comprises glycol.

Embodiment 61: The system of embodiment 58, wherein the heat exchange fluid comprises glycol and water.

Definitions

The terms used in this specification generally have their ordinary meanings in the art, within the context of the disclosure, and in the specific context where each term is used. Alternative language and synonyms may be used for any one or more of the terms discussed herein, and no special significance should be placed upon whether or not a term is elaborated or discussed herein. In some cases, synonyms for certain terms have been provided. A recital of one or more synonyms does not exclude the use of other synonyms. The use of examples anywhere in this specification including examples of any terms discussed herein is illustrative only and is not intended to further limit the scope and meaning of the disclosure or of any example term. Likewise, the disclosure is not limited to various embodiments given in this specification.

Concentrations, amounts, and other numerical data may be expressed or presented herein in a range format. It is to be understood that such a range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 2 to about 50" should be interpreted to include not only the explicitly recited values of 2 to 50, but also include all individual values and sub-ranges within the indicated range. Thus, included in this numerical range are individual values such as 2, 2.4, 3, 3.7, 4, 5.5, 10, 10.1, 14, 15, 15.98, 20, 20.13, 23, 25.06, 30, 35.1, 38.0, 40, 44, 44.6, 45, 48, and sub-ranges such as from 1-3, from 2-4, from 5-10, from 5-20, from 5-25, from 5-30, from 5-35, from 5-40, from 5-50, from 2-10, from 2-20, from 2-30, from 2-40, from 2-50, etc. This same principle applies to ranges reciting only one numerical value as a minimum or a maximum. Furthermore, such an interpretation should apply regardless of the breadth of the range or the characteristics being described.

As used herein, the terms "a," "an," and "the" are understood to encompass the plural as well as the singular. Thus, the term "a mixture thereof" also relates to "mixtures thereof" and the term "a component" also refers to "components."

As used herein, the term "about" is used to provide flexibility to a numerical range endpoint by providing that a given value may be "a little above" or "a little below" the endpoint. For example, the endpoint may be within 10%, 8%, 5%, 3%, 2%, or 1% of the listed value. Further, for the sake of convenience and brevity, a numerical range of "about 50 mg/mL to about 80 mg/mL" should also be understood to provide support for the range of "50 mg/m L to 80 mg/mL."

In this disclosure, "comprises," "comprising," "containing," and "having" and the like can have the meaning ascribed to them in U.S. Patent Law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the composition's nature or characteristics would be permissible if present under the "consisting essentially of" language, even though not expressly recited in a list of items following such terminology. In this specification when using an open-ended term, like "comprising" or "including," it is understood that direct support should be afforded also to "consisting essentially of" language as well as "consisting of" language as if stated explicitly and vice versa.

Having described several embodiments, it will be recognized by those skilled in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present systems and methods, which, as a matter of language, might be said to fall therebetween.

What is claimed is:

1. A membrane assembly comprising:
an anion exchange membrane;
a cation exchange membrane;
a hydrophilic layer disposed between the anion exchange membrane and the cation exchange membrane; and
an anion exchange coating disposed between the hydrophilic layer and the anion exchange membrane,
wherein the hydrophilic layer is laminated to the anion exchange membrane or the cation exchange membrane, and
wherein the anion exchange coating comprises a catalyst selected from the group consisting of platinum, titanium, iridium, gold, palladium, silver, ruthenium, rhodium, osmium, and combinations thereof.

2. The assembly of claim 1, wherein the anion exchange membrane is a hydroxide ion-conducting membrane.

3. The assembly of claim 2, wherein the anion exchange membrane comprises imidazolium functionalized styrene polymers, polysulfone and derivatives thereof, polymers with quaternary phosphonium groups, or combinations thereof.

4. The assembly of claim 1, wherein the cation exchange membrane is a proton conducting membrane.

5. The assembly of claim 4, wherein the proton conducting membrane comprises a polymer having the formula $C_7HF_{13}O_5S{\cdot}C_2F_4$.

6. The assembly of claim 1, wherein the cation exchange membrane comprises sulfonated poly(ether ether ketone) (sPEEK), sulfonated phenylated poly(phenylene) (sPPP), sulfonated polyether (sulfone) (SPES), sulfonated polystyrene-b-poly(ethylene-r-butylene-b-polystrene (S-SEBS), or combinations thereof.

7. The assembly of claim 1, wherein the hydrophilic layer comprises a polymer with hydrophilic groups.

8. The assembly of claim 1, wherein the hydrophilic layer is laminated to the anion exchange membrane and the cation exchange membrane.

9. The assembly of claim 1, wherein the hydrophilic layer has a porosity from about 10% to about 20%.

10. The assembly of claim 1, wherein the hydrophilic layer has a thickness from about 10 microns to about 50 microns.

11. The assembly of claim 1, wherein the anion exchange membrane has a thickness from about 10 microns to about 75 microns.

12. The assembly of claim 1, wherein the cation exchange membrane has a thickness from about 10 microns to about 75 microns.

13. The assembly of claim 1, wherein the hydrophilic layer comprises a polymer selected from the group consisting of poly(2-hydroxyethyl methacrylate-co-ethylene dimethacrylate) (HEMA-co-EDMA), polyethylene glycol diacrylate (PEGDA), poly-2-hydroxyethyl methacrylate (PHEMA), polyvinylpyrrolidone (PVP), polyethylene glycol (PEG), polyetheretherketone (PEEK), polyethersulfone (PES), polyetherketoneketone (PEEKK), polyimide (PI), polyvinyl alcohol (PVA), or a combination thereof.

14. The membrane assembly of claim 1, further comprising a cation exchange coating disposed between the hydrophilic layer and the cation exchange membrane.

15. The membrane assembly of claim 14, wherein the cation exchange coating comprises a catalyst selected from the group consisting of platinum, titanium, iridium, gold, palladium, silver, ruthenium, rhodium, osmium, and combinations thereof.

16. A membrane electrode assembly, the assembly comprising,
the membrane assembly of claim 1;
an anode comprising an anode catalyst; and
a cathode comprising a cathode catalyst.

17. A membrane assembly, the assembly comprising:
an anion exchange membrane;
a cation exchange membrane;
a first hydrophilic layer and a second hydrophilic layer disposed between the anion exchange membrane and the cation exchange membrane; and
an anion exchange coating disposed between the hydrophilic layer and the anion exchange membrane,
wherein the first hydrophilic layer is laminated to the anion exchange membrane and the second hydrophilic layer is laminated to the cation exchange membrane, and
wherein the anion exchange coating comprises a catalyst selected from the group consisting of platinum, titanium, iridium, gold, palladium, silver, ruthenium, rhodium, osmium, and combinations thereof.

18. The membrane assembly of claim 17, further comprising an anion exchange coating disposed between the first hydrophilic layer and the anion exchange membrane.

19. The membrane assembly of claim 17, further comprising a cation exchange coating disposed between the second hydrophilic layer and the cation exchange membrane.

20. A membrane assembly comprising:
an anion exchange membrane;
a cation exchange membrane;
a hydrophilic layer disposed between the anion exchange membrane and the cation exchange membrane; and
a cation exchange coating disposed between the hydrophilic layer and the cation exchange membrane,
wherein the hydrophilic layer is laminated to the anion exchange membrane or the cation exchange membrane, and
wherein the cation exchange coating comprises a catalyst selected from the group consisting of platinum, titanium, iridium, gold, palladium, silver, ruthenium, rhodium, osmium, and combinations thereof.

* * * * *